US008782970B2

(12) United States Patent
Griffiths

(10) Patent No.: US 8,782,970 B2
(45) Date of Patent: Jul. 22, 2014

(54) PORTABLE SURFACE ANCHOR

(76) Inventor: Scott Eugene Griffiths, Midwest, WY (US)

( * ) Notice: Subject to any disclaimer, the term of this patent is extended or adjusted under 35 U.S.C. 154(b) by 62 days.

(21) Appl. No.: 13/086,993

(22) Filed: Apr. 14, 2011

(65) Prior Publication Data

US 2012/0260584 A1 Oct. 18, 2012

(51) Int. Cl.
*E02D 5/74* (2006.01)

(52) U.S. Cl.
USPC ..... 52/155; 52/153

(58) Field of Classification Search
USPC ..... 52/155, 153, 156, 162
See application file for complete search history.

(56) References Cited

U.S. PATENT DOCUMENTS

| | | | | |
|---|---|---|---|---|
| 729,591 | A | 6/1903 | Jacobs | |
| 3,554,495 | A * | 1/1971 | Bach et al. | 256/19 |
| 4,406,100 | A | 9/1983 | Keesee et al. | |
| 5,123,623 | A * | 6/1992 | McNamara | 248/545 |
| 7,240,743 | B2 * | 7/2007 | Buss et al. | 175/58 |
| 7,380,561 | B2 | 6/2008 | Nobert et al. | |

* cited by examiner

*Primary Examiner* — Basil Katcheves
(74) *Attorney, Agent, or Firm* — Peter J. Timbers; Schwartz, Bon, Walker & Stoder, LLC

(57) ABSTRACT

A portable surface anchor is presented. Such portable surface anchor is able to be transported to various and difficult geographical areas, placed on the surface and able to provide support for vertically elevated objects.

20 Claims, 7 Drawing Sheets

FULLY RETRACTED

FULLY DEPLOYED

PORTABLE SURFACE ANCHOR

FIELD OF THE INVENTION

This invention relates generally to a surface anchor able to be transported to various geographical areas, placed on the surface and able to provide support for vertically elevated objects.

BACKGROUND OF THE INVENTION

There exist many means of stabilizing elevated structures. In the petroleum industry, the earth anchor is one of the most common. Earth anchors are often used for anchoring derricks, which can often reach up to approximately one hundred feet in height. Earth anchors come in a variety of types, including: expandable wing anchors; helical (helix) anchors; flat plate anchors; and, T-bar anchors. All of these types of anchors require excavation for installation in the earth.

Typically, the derrick position is chosen in light of many factors, including: local geographical features; field equipment; and, underground structures. These same considerations as well as manufacturers' engineering specifications and governmental regulations, also mandate where derrick-supporting anchors are to be placed. Underground structures include cables, lines, conduit and piping for utilities, such as gas, electricity and water.

Frequently underground structures are compromised during excavation, which is required for placement of an earth anchor. The results can be devastating, including property damage, loss of product, environmental harm, personal injury and loss of life. Over the years, safety regulations have increased in response to injuries and death caused by excavation that compromises underground structures. Restrictions on excavation location and depth have become ever more stringent in order to avoid the above-mentioned damages.

Natural variations in local terrain, climate and geography limit placement of earth anchors. Rocks, unstable soil, previously excavated soil, and shallow ground water levels often make excavation impractical, if not impossible, in the fewer and fewer sites where excavation is allowed.

In addition to the regulatory and geographical limitation, excavation also faces constraints regarding surface and mineral interests. Rights-of-way, pits, roads, fences, and equipment limit excavation possibilities for placement of earth anchors. An example of both underground and surface limitations is a multiple well pad site. With more than one well per location, there are often separate underground utilities, property interests for both the surface and mineral estates, and multiple company ownership of structures and equipment. All the competing interests found in a multiple well pad site often impede and severely curtail excavation, thereby limiting earth anchor preparation for placement.

Vertically elevated structures require support. Earth anchors have become too cumbersome to meet the needs in the field. Thus, there is a long felt need for alternatives to earth anchors.

SUMMARY OF THE INVENTION

Accordingly, it is an object of embodiments of the present invention to provide a portable surface anchor stabilization of vertically elevated objects.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects, and in accordance with the purposes of the present invention, as embodied and broadly described herein, the portable surface anchor for deployment on a ground surface includes: a support frame comprising at least two rails; a container comprising a front wall and an opposing back wall and attached to said support frame; at least two pointed front teeth, each of said front teeth comprising a spike adapted for penetrating said surface beneath said surface anchor; first means attached to the front wall of said container for deploying said at least two pointed front teeth.

In another embodiment the portable surface for deployment on a ground surface hereof includes: a support frame, a rectangular container attached to the support frame, at least two pointed front teeth, each of the front teeth adapted for penetrating the surface beneath said surface anchor, first means attached to the front wall of said container for deploying said at least two front teeth, at least two pointed back teeth, each of said back teeth adapted for penetrating the surface beneath said surface anchor, and second means attached to the back wall of said container for deploying said at least two back teeth.

The support frame of the portable surface anchor comprises a first side rail, a second side rail parallel to said first side rail and spaced apart therefrom, a third rail parallel to said first side rail and said second side rail and disposed therebetween, a front cross member perpendicular to and attached to said first rail, said second rail and said third rail, a rear cross member perpendicular to and attached to said first rail, said second rail and said third rail, two first parallel cross members between the front cross member and the rear cross member, one of said first parallel cross members attached to the first and third rails and the other said first parallel cross members attached to the second and third cross rails, two second parallel cross members between the two first parallel cross members and the rear cross member, one of said second parallel cross members attached to the first and third rails and the other said second parallel cross members attached to the second and third cross rails, two intermediate parallel cross members disposed between the two first parallel cross members and the two second parallel cross members.

The rectangular container of the portable surface anchor has a front wall, an opposing back wall, a first side wall, an opposing second side wall, and a bottom, and attached to the support frame.

Benefits and advantages of the present invention include, but are not limited to, providing an apparatus stabilizing elevated objects, which is portable and can function in a variety of terrains, and accommodate a wide variety of ground surfaces, including frozen tundra.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION OF THE INVENTION

Figure 1:
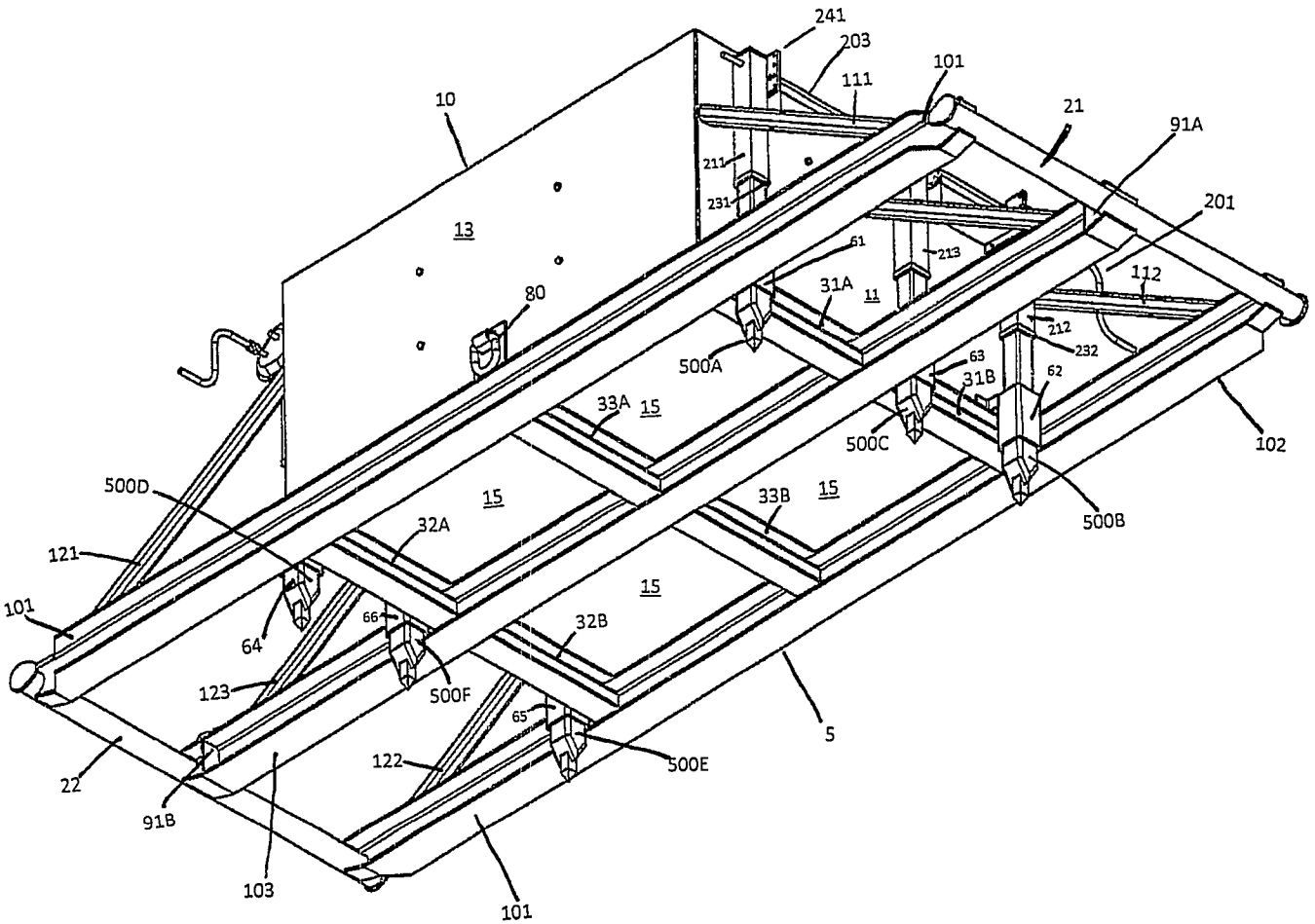
FIG. 1 illustrates a perspective view of the bottom of one embodiment of the present invention showing the frame and the rectangular container.

Reference will now be made in detail to embodiments of the invention, examples of which are illustrated in the accompanying drawings. Throughout the following detailed description, the same reference characters refer to the same or similar elements in all figures.

FIG. 1 depicts a support frame 5 underneath and supporting a rectangular container 10. The support frame 5 comprises a first side rail 101, a second side rail angle support attachments, and a third side rail 103 therebetween. The support frame 5 also comprises a front cross member 21 perpendicular to and attached to the first rail, the second rail and the third rail. The support frame also comprises a rear cross member 22 perpendicular to and attached to the first rail, the second rail and said the rail. The front cross member 21 is parallel to the rear cross member 22. The rails 101, 102 and 103 are parallel to each other.

The support frame 5 also comprises two first parallel cross members 31A and 31B between the front cross member 21 and the rear cross member 22 and attached to the first rail 101 and third rail 103 and second rail 102 and third rail 103, respectively. The support frame further comprises two second parallel cross members 32A and 32B disposed between the two first parallel cross members 31A and 31B and the rear cross member 22 and attached to the first rail 101 and third rail 103 and second rail 102 and third rail 103, respectively. The support frame further comprises two intermediate parallel cross members 33A and 33B disposed between the two first parallel cross members 31A and 31B and the two second parallel cross members 32A and 32B and attached to the first rail 101 and third rail 103 and second rail 102 and third rail 103, respectively.

FIG. 1 also depicts six pointed teeth 500A, 500B, 500C, 500D, 500E, and 500F fully deployed. The three pointed front teeth 500A, 500B and 500C protrude through teeth guides 61, 62 and 63, respectively. Typically, such teeth are fully deployed prior to placing the portable surface anchor on the ground in its desired location.

FIG. 1 depicts a rectangular container 10 having a front wall 11, a side wall 13 and a bottom 15. FIG. 1 further depicts a first front buttress 111 attached to the first rail 101 and to the front wall 11. A second front buttress 112 is attached to the second rail 102 and to the front wall 11. A third front buttress 113 attached to the third rail 103 and to the front wall 11. Although not depicted, a first back buttress 121 is attached to the first rail 101 and to the back wall 12, second back buttress 122 is attached to the second rail 102 and to the back wall 12, and a third back buttress 123 is attached to said third rail 103 and to the back wall 12. The attachments of the back buttresses 121, 122, and 123 to the back wall 12 are not depicted in FIG. 1. However, the attachments are the same as the front buttresses 110, 111, and 112, to the front wall 11. The buttresses provide support to the container when it is filled with concrete.

Figure 2:
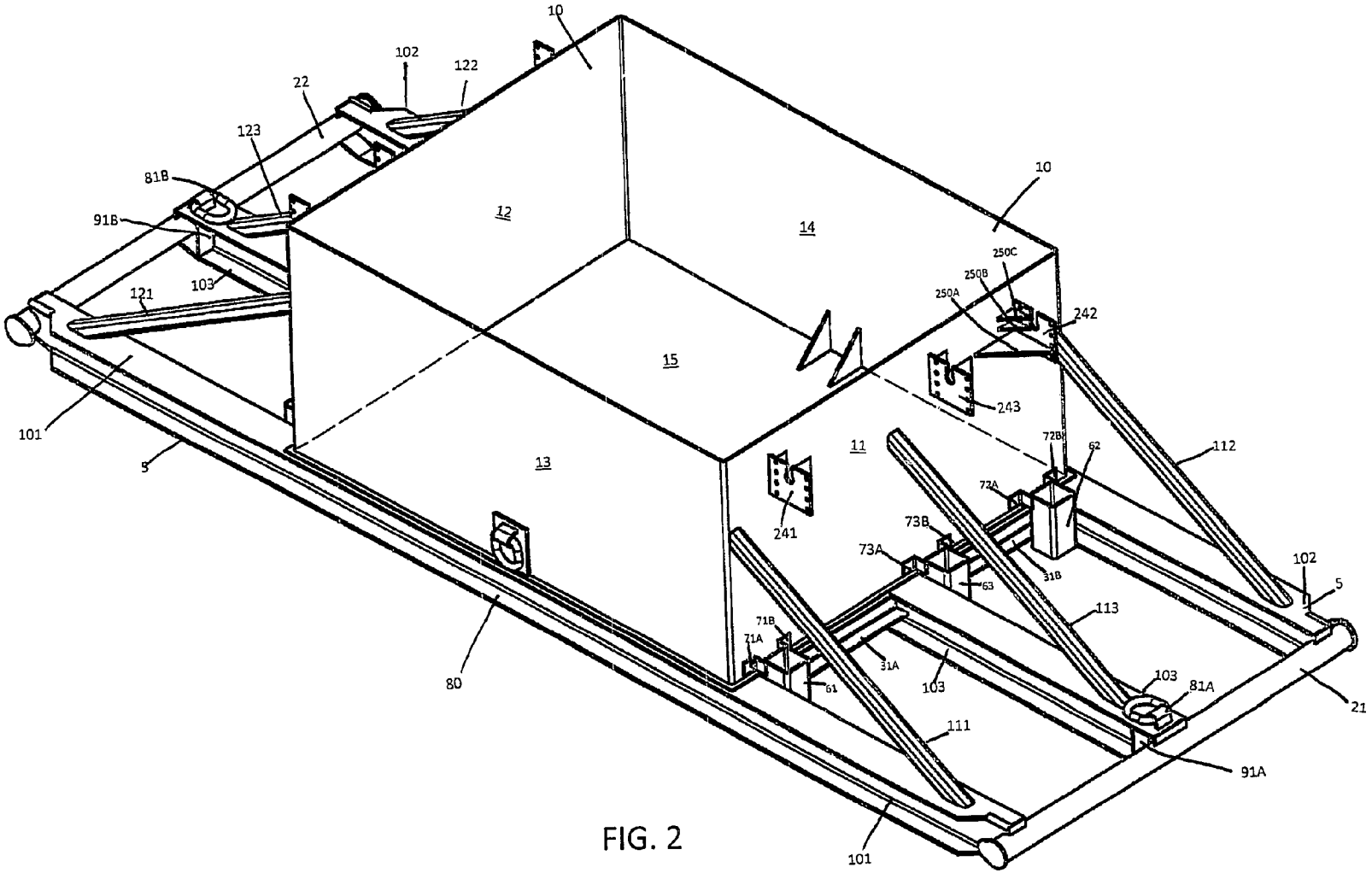
FIG. 2 illustrates a perspective view of the top of the embodiment of the present invention shown in FIG. 1 hereof.

FIG. 2 depicts the support frame 5 underneath the rectangular container 10. The rectangular container 10 comprises a front wall 11, an opposing back wall 12, a first side wall 13, an opposing second side wall 14, and a bottom 15. The rectangular container 10 is attached to the support frame 5, whereby the first side wall 13 and bottom 15 are attached to the first side rail 101, the second side wall 14 and bottom 15 are attached to the second side rail 102, and the bottom 15 is attached to the third rail 103.

FIG. 2 depicts tooth guide 61 attached to the first side rail 101 and the first parallel cross member 31A. FIG. 2 also depicts tooth guide angle support attachments 71A and 71B attached to tooth guide 61 and the wall 11. Likewise, tooth guide 62 is attached to the second side rail 102 and first parallel cross member 31B with tooth guide angle support attachments 72A and 72B attached to tooth guide 62 and the front wall 11. Tooth guide 63 is attached to the third rail 103 and first parallel cross member 31B with tooth guide angle support attachments 73A and 73B attached to tooth guide 63 and the wall 11. The angle support attachments provide stability and support for the tooth guides as the portable surface anchor is deployed and used in operation.

FIG. 2 also depicts an at least one D-ring 80 attached to the bottom of the first side wall 13, two D-rings 81A and 81B are attached to the third rail 103. Although not depicted, the invention typically comprises at least one D-ring attached to the bottom of the opposing second side wall 14. FIG. 2 depicts reinforced plates 91A and 91B attached to the third rail 103 underneath D-rings 81A and 81B, respectively. As lines are attached to D-rings during attachment to vertically elevated objects, the reinforced plates provide additional support to maintain D-ring attachment and rail integrity for the portable surface anchor.

Figure 3:
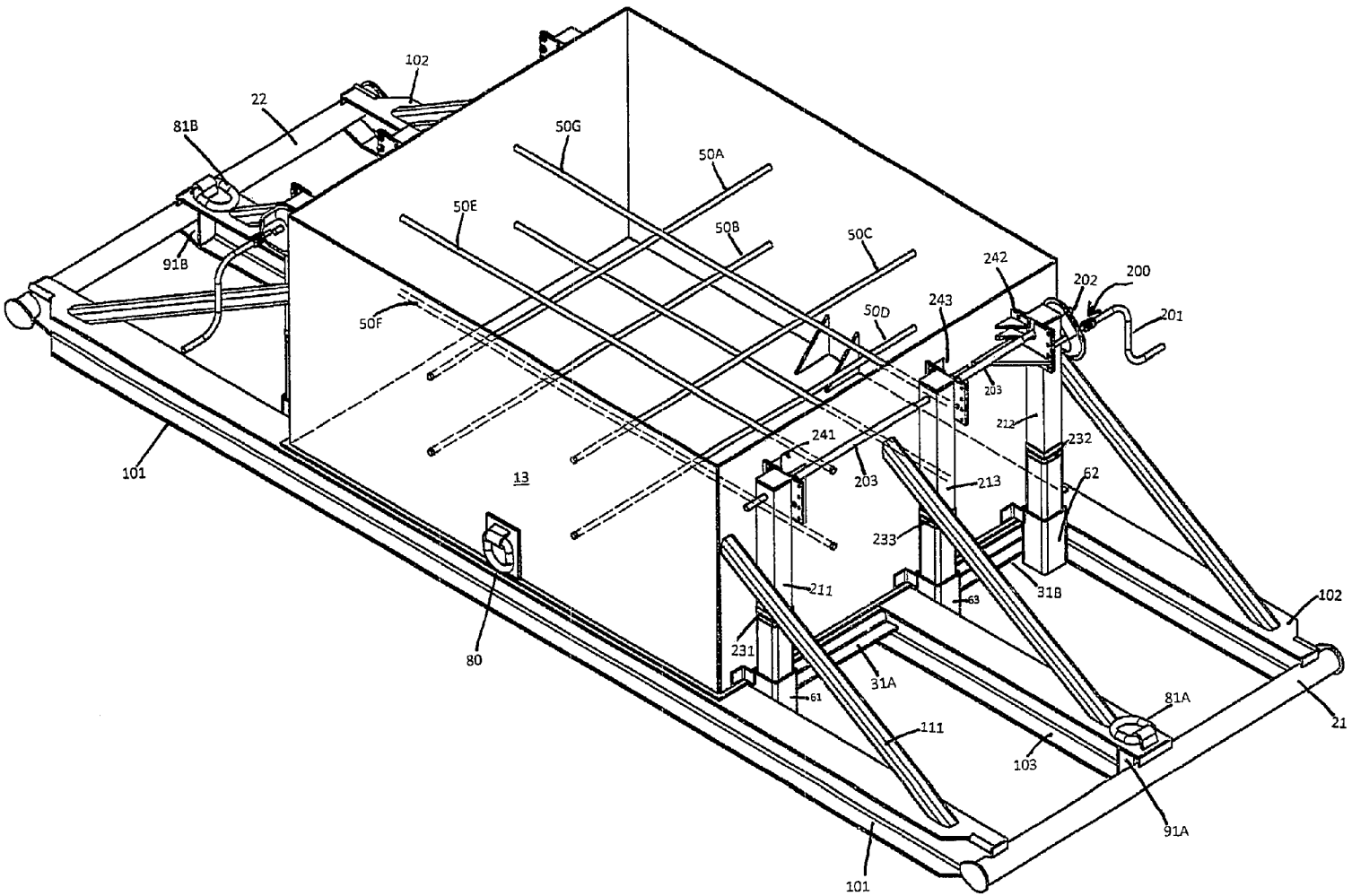
FIG. 3 illustrates another perspective view of the top of the embodiment of the present invention shown in FIG. 2 hereof, further showing the front teeth in the retracted condition and internal support members of the container.

FIG. 2 shows mounting gear mounting plates 241, 242 and 243 for landing gear attachment to the front wall 11, as shown in FIG. 3. Such mounting plates provide additional support and maintain attachment of the landing gear to the remainder of the portable surface anchor when in use. FIG. 2 also shows landing gear support gussets 250A, 250B and 250C attached to the landing gear mounting plate 242 and the front wall 11.

FIG. 3 further depicts reinforcement bars 50A, 50B, 50C, 50D, 50E, 50F, 50G and 50H attached to the walls inside container 10. The portable anchor depicted in FIG. 3 shows the front cross member 21 and the rear cross member 22 comprising tail roll piping. Tail roll piping provides for effective hauling of the portable surface anchor and provides for less wear and tear on cables and ropes as the invention is picked up in order to be transported.

Figure 5:
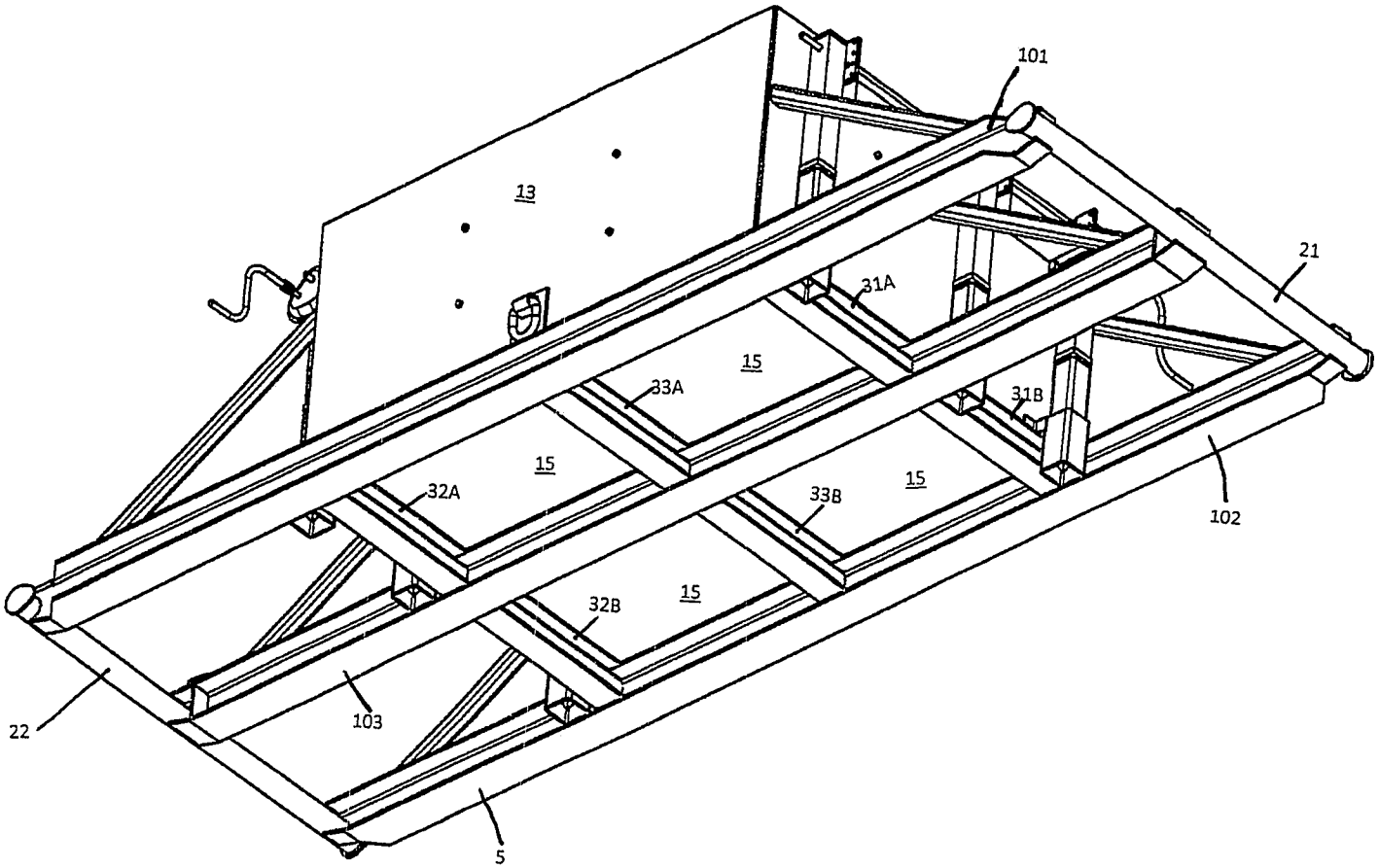
FIG. 5 illustrates a bottom perspective view of the embodiment of the present invention shown in FIG. 3 here of showing the teeth in their retracted condition.

FIG. 3 depicts a landing gear assembly 200, showing landing gear crank 201, landing gear drive box 202, landing gear drive rod 203, landing gear sleeves 211, 212 and 213 and landing gear sleeve collars 231, 232 and 233. In FIG. 3, the pointed teeth are not deployed, therefore the landing gear drive shafts are not exposed, and the teeth remain in tooth guides 61, 62 and 63 (similar to the non-deployed teeth shown in FIG. 5).

Figure 4:
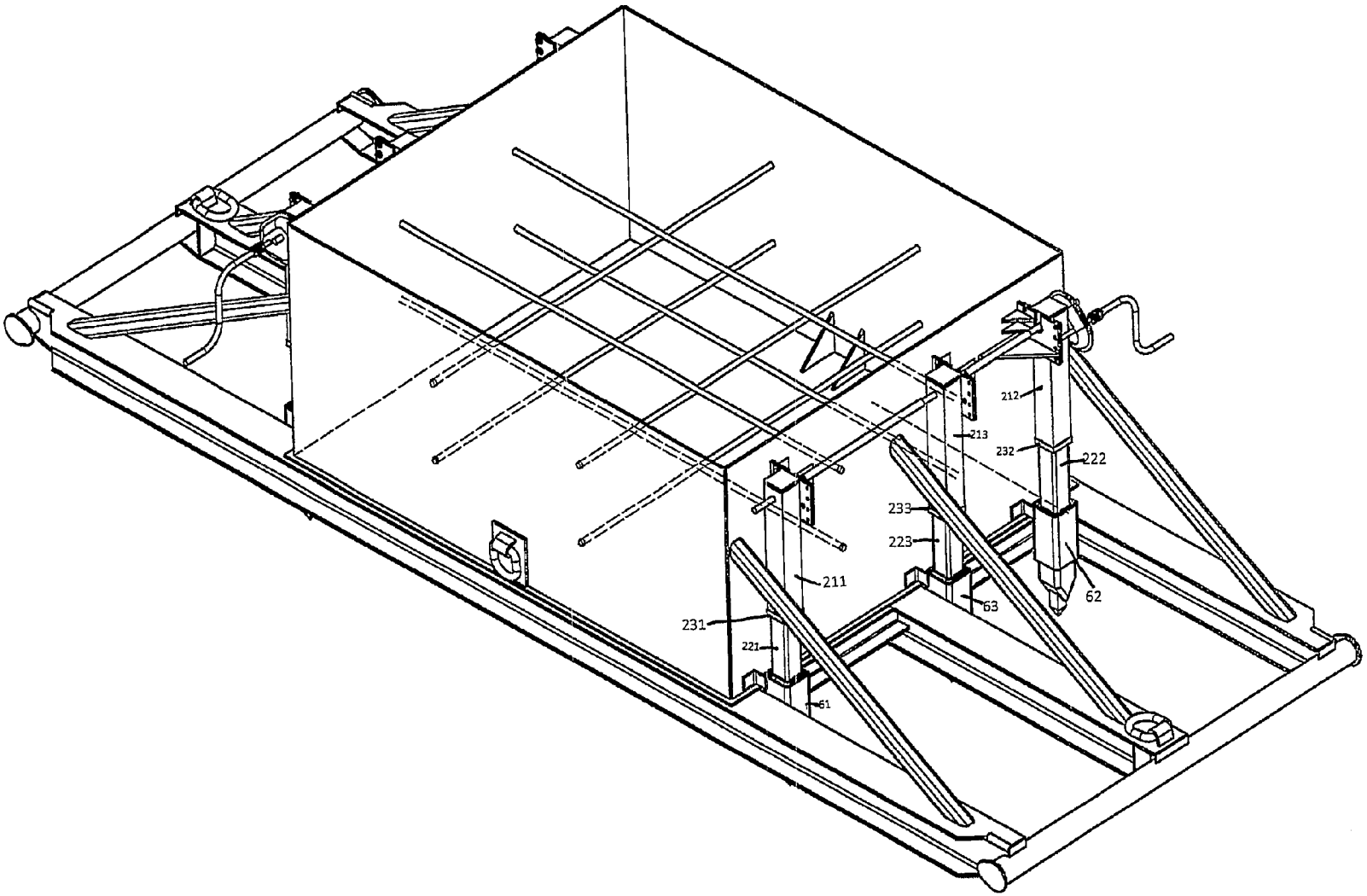
FIG. 4 illustrates yet another perspective view of the embodiment of the present invention shown in FIG. 2 hereof, further showing the front teeth and back teeth in their deployed condition.

FIG. 4 shows a view of deployed teeth, as shown in FIG. 1, although only deployed tooth 500B is visible in FIG. 4. When the teeth are fully deployed, the surface anchor becomes highly effective for maintaining its position relative to horizontal movement. Because an anchor is horizontally separated from the vertically elevated object it is supporting, it is essential that no horizontal movement of the surface anchor occurs.

FIG. 4 shows the landing gear drive shafts 221, 222 and 223, which are in communication with the landing gear drive rod 203. When the landing gear shafts 221, 222 and 223 are fully retracted, they are partially contained in the landing gear sleeves 211, 212 and 213, respectively. The landing gear shaft collars 231, 232, and 233 are attached to the bottom of the landing gear sleeves 211, 212, and 213, respectively. In FIG. 4, the landing gear shaft sleeves, 211, 212, and 213, are attached to the front wall 11. Although not depicted in FIG. 4, the back wall has similar landing gear assembly attachments as the front wall.

Figure 6C:
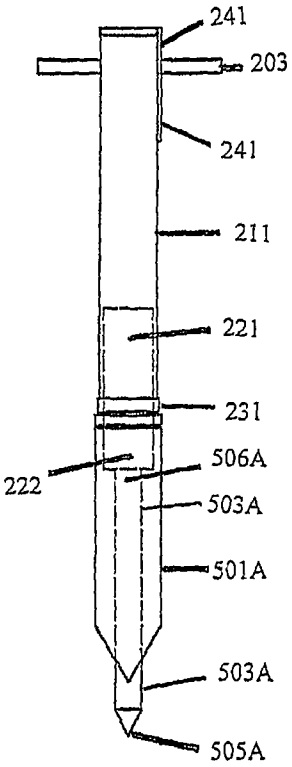
FIG. 6C illustrates a side view of the pointed tooth shown in FIG. 6B in its fully retracted condition.
Figure 6B:
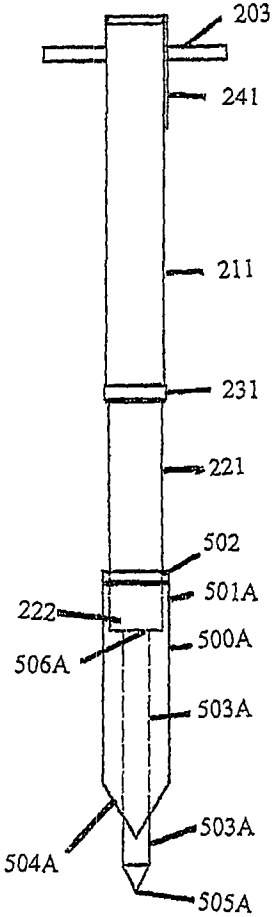
FIG. 6B illustrates a side view of the fully deployed tooth shown in FIG. 6A hereof.
Figure 6A:
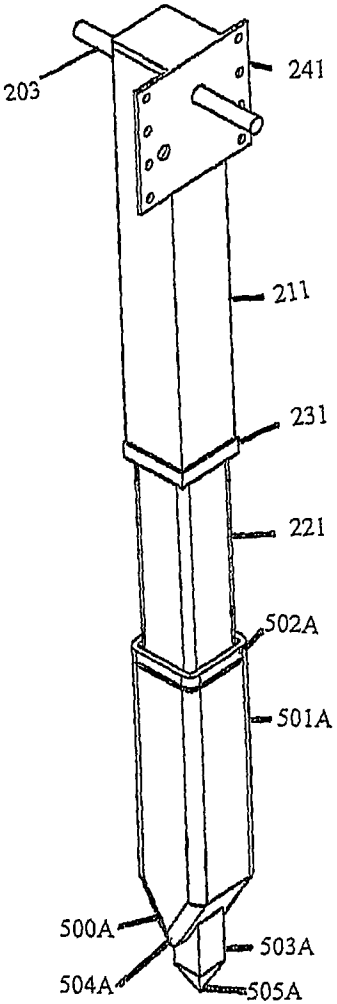
FIG. 6A illustrates a perspective view of a pointed tooth, pursuant to one embodiment of the present invention.

FIG. 6A shows a fully deployed pointed tooth 500A. The tooth 500A comprises a spike casing 501A and a spike 503A. The spike casing comprises a rim 502A and an apexed portion 504A. FIG. 6A shows the landing gear mounting plate 241 which is attached to a front wall 11. Although not depicted in FIG. 6, the tooth features and tooth attachments are the same for teeth 500B, 500C, 500D, 500E, and 500F.

When the tooth 500A is fully retracted, the landing gear shaft 221 is at least partially inside the landing gear sleeve 211. Deployment of the tooth requires the landing gear rod 203 to communicate with the landing gear shaft 221. Prior to deployment of tooth 500A, the landing gear collar 231 is in contact with the rim 502A, as shown in FIG. 6C.

FIG. 6A shows a portion of the spike 503A with a pointed end 505A, which enhances the tooth's ability to penetrate frozen and very rocky terrain. FIG. 6B and FIG. 6C show how the spike 503A is partially contained in the spike casing 503A and attached to the landing gear shaft 221 with its non-pointed end 506A. The apexed portion 504A of the spike casing 501A provides additional support for the spike 503A as ground is punctured and aids in the movement of earth as the portable surface anchor is lowered to its anchoring position.

Figure 7:
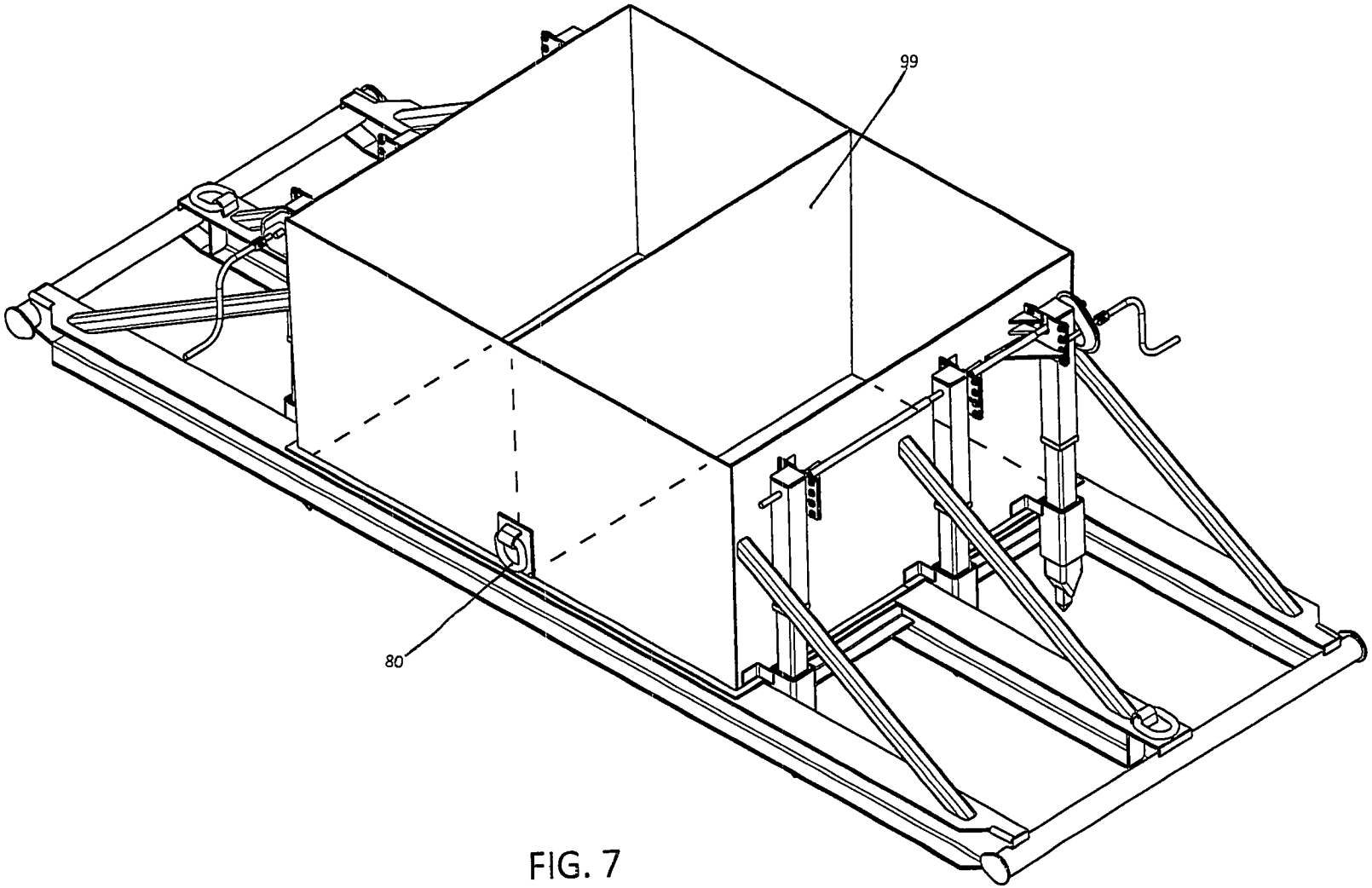
FIG. 7 illustrates a perspective view of the top of and embodiment of the present invention, showing a divider placed in the container.

FIG. 7 shows one embodiment of the current invention wherein a divider 99 separates the container into at least two containers. The divider 99 also provides support for D-ring 80 and the opposing side D-ring (not depicted). One or more dividers, like divider 99, provide for concrete blocks to be deposited into the one or more containers. Concrete blocks can be shipped separately, thereby making the anchor and its weights easier to be transported.

In actual use, the portable surface anchor is tied off with a line connecting the D-ring to an upper portion of an elevated structure. The six tooth design has been an improvement over a four tooth design. The six tooth design allows the portable surface anchor to be deployed without preparation and smoothing of the underlying earth. Given the variety of terrain where anchors are required, a six tooth design accommodates curvature and uneven terrain as well as frozen earth. Thus, the surface does not have to be smoothed, softened or thawed.

There are a variety of means for deploying the teeth. One such means is the landing gear assembly shown herein. Such landing gear is commercially available and typically used in the trucking industry, e.g., SAF/Holland Model LG 4000-720000000. Such landing gear can accommodate very heavy portable surface anchors. In one embodiment, the portable surface anchor, when fully constructed weighed over 48,000 lbs.

In one embodiment of the present invention, the pointed teeth typically extend approximately 12 inches from the bottom of the portable surface anchor when fully deployed. In another embodiment of the present invention, the spike portion extends approximately 2 inches from the apexed portion. The 12 inch penetration of earth is a safe depth relative to the deeper locations of almost all underground structures including utility lines and water piping or structures.

In one embodiment, the deployable are adjustable. Thus, the depth of surface penetration can be selectively chosen in order to avoid underground structures that are at a more shallow depth. The portable surface anchor was tested at a 2 inch depth for all six pointed teeth. Even at this minimal depth of deployment/penetration, the portable surface anchor remained in constant position with an applied load well above industry standard service loads and required field testing limits.

The figures herein have shown a front view of the invention. It is important to note that in one embodiment the front and back sides identical in tooth, landing gear attachments and buttresses.

It is believed that the apparatus of the present invention and many of its attendant advantages will be understood from the foregoing description. It is also believed that it will be apparent that various changes may be made in the form, construction, and arrangement of the components without departing from the scope and spirit of the invention and without sacrificing its material advantages. The forms described are merely exemplary and explanatory embodiments thereof. It is the intention of the following claims to encompass and include such changes.

What is claimed is:

1. A portable surface anchor for deployment on a ground surface comprising:

a support frame:

a first side rail;

a second side rail parallel to said first side rail and spaced apart therefrom;

a third rail parallel to said first side rail and said second side rail and disposed therebetween;

a front cross member perpendicular to and attached to said first rail, said second rail and said third rail;

a rear cross member perpendicular to and attached to said first rail, said second rail and said third rail;

two first parallel cross members between said front cross member and said rear cross member, one of said first parallel cross members attached to the first and third rails and the other of said first parallel cross members attached to said second and third cross rails;

two second parallel cross members between the two first parallel cross members and the rear cross member, one of said second parallel cross members attached to said first and third rails and the other of said second parallel cross members attached to said second and third cross rails;

two intermediate parallel cross members are disposed between said two first parallel cross members and said two second parallel cross members;

a rectangular container having a front wall, an opposing back wall, a first side wall, an opposing second side wall, and a bottom, and attached to said support frame;

at least two pointed front teeth, each of said front teeth adapted for penetrating said surface beneath said surface anchor; first means attached to the front wall of said container for deploying said at least two front teeth; and at least two pointed back teeth, each of said back teeth adapted for penetrating said surface beneath said surface anchor; and second means attached to the back wall of said container for deploying said at least two back teeth.

2. The portable surface anchor of claim 1, further comprising:

a first front buttress attached to said first rail and to the front wall;

a second front buttress attached to said second rail and to the front wall;

a third front buttress attached to said third rail and to the front wall;

a first back buttress attached to said first rail and to the back wall;

a second back buttress attached to said second rail and to the back wall; and a third back buttress attached to said third rail and to the back wall.

3. The portable surface anchor of claim 1, wherein said container is filled with concrete.

4. The portable surface anchor of claim 1, wherein said rectangular container further comprises reinforcement bars attached to the walls of said container.

5. The portable surface anchor of claim 1, wherein said rectangular container further comprises at least one divider that separates said container into at least two containers.

6. The portable anchor of claim 1, wherein said front support comprises tail roll piping.

7. The portable anchor of claim 1, wherein said back support comprises tail roll piping.

8. The portable anchor of claim 1, further comprising at least one D-ring attached to the bottom of said first side wall.

9. The portable anchor of claim 1, further comprising at least one D-ring attached to the bottom of said opposing second side wall.

10. The portable anchor of claim 1, further comprising at least one D-ring attached to said third rail.

11. The portable anchor of claim 1, wherein said pointed teeth comprise a spike casing and a spike.

12. The portable anchor of claim 1, further comprising at least one tooth guide attached to said first rail and one of said two first parallel cross members.

13. The portable anchor of claim 1, further comprising a tooth guide attached to said second rail and one of said two first parallel cross members.

14. The portable anchor of claim 1, further comprising a tooth guide attached to said third rail and one of said first parallel cross members.

15. The portable anchor of claim 1, further comprising at least one tooth guide attached to said first rail and one of said two second parallel cross members.

16. The portable anchor of claim 1, further comprising a tooth guide attached to said second rail and one of said two second parallel cross members.

17. The portable anchor of claim 1, further comprising a tooth guide attached to said third rail and one of said second parallel cross members.

18. A portable surface anchor for deployment on a ground surface, said portable surface anchor comprising a support frame, a container, a deployable tooth and a tooth guide, said support frame comprising a first side rail, a second side rail and a cross member in contact with said first side rail and said second side rail, said container in contact with said support frame and at least partially filled with concrete, said tooth guide comprising walls and having an inner perimeter, a top opening and a bottom opening, said openings and said inner perimeter telescopically housing and accommodating movement of said deployable tooth therethrough to penetrate said ground surface.

19. The portable surface anchor of claim 18, wherein said deployable tooth further comprises a top portion, a bottom portion and a spike extending from the bottom portion.

20. The portable surface anchor of claim 18 further comprising a D-ring attached to said surface anchor.

* * * * *